US008240238B2

(12) United States Patent
Willner

(10) Patent No.: US 8,240,238 B2
(45) Date of Patent: Aug. 14, 2012

(54) METHODS AND APPARATUSES FOR DETECTING AND NEUTRALIZING REMOTELY ACTIVATED EXPLOSIVES

(76) Inventor: Byron J. Willner, Hot Springs, VA (US)

( * ) Notice: Subject to any disclaimer, the term of this patent is extended or adjusted under 35 U.S.C. 154(b) by 260 days.

(21) Appl. No.: 12/592,337

(22) Filed: Nov. 24, 2009

(65) Prior Publication Data

US 2010/0170383 A1 Jul. 8, 2010

Related U.S. Application Data

(63) Continuation-in-part of application No. 12/126,570, filed on May 23, 2008, now abandoned.

(51) Int. Cl.
*F41H 11/18* (2011.01)

(52) U.S. Cl. ..... 89/1.13; 102/403

(58) Field of Classification Search ..... 89/1.13; 102/402, 403

See application file for complete search history.

(56) References Cited

U.S. PATENT DOCUMENTS 5,155,683 A * 10/1992 Rahim ..... 701/25
7,624,667 B2 * 12/2009 Kilkis ..... 89/1.13

* cited by examiner

*Primary Examiner* — Stephen M Johnson
(74) *Attorney, Agent, or Firm* — Alfred F. Hoyte, Jr.

(57) ABSTRACT

A system and apparatus for detecting and neutralizing remotely activated explosive devices in a combat zone, especially one of relatively limited geographic area such as an urban setting. The apparatus is configured for mounting on or within an airborne drone and includes both transmitting and receiving circuits and antennas. The apparatus detects radio transmissions by analyzing received signals using standard RF direction finding techniques and a spectrum analyzer or other signal processing circuitry. Signals may be classified as threats using predetermined criteria, and the direction of threat signals may be assessed to allow for a determination of an enemy position from which an explosive is to be detonated. The apparatus also transmits a jamming signal which may serve to detonate devices within the dynamic RF footprint of the transmitting antenna. The drone also includes a highly directional low frequency audio device which is periodically directed randomly and at suspected enemy positions.

10 Claims, 8 Drawing Sheets

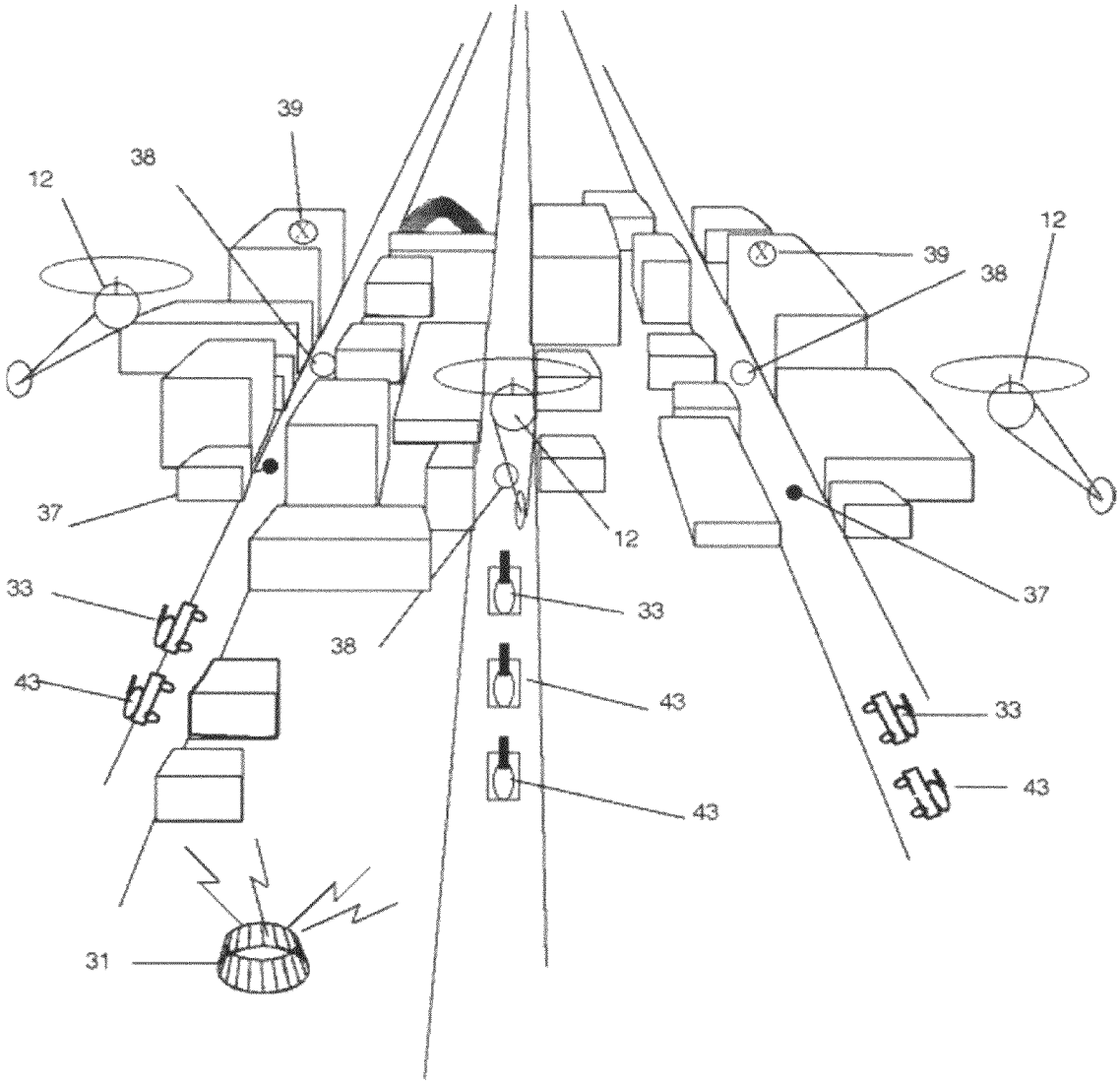
FUGURE 7A

METHODS AND APPARATUSES FOR DETECTING AND NEUTRALIZING REMOTELY ACTIVATED EXPLOSIVES

This application is a continuation in part of application Ser. No. 12/126,570 filed May 23, 2008 now abandoned. FIG. 2 of application Ser. No. 12/126,570 filed May 23, 2008 (US Pub. App. 20090288550) is hereby incorporated by reference.

BACKGROUND OF INVENTION

The present invention is directed to electronic and audio countermeasures for use in a wartime environment. More specifically, the invention concerns a device which can use both electronic and audio countermeasures to explode or deactivate various types of remotely controlled or condition responsive explosive devices such as IEDs and land mines.

Many types of devices, systems, and methods have been developed over the years to counter stationary explosive devices of the type configured for use in a wartime environment. These devices, which include land mines and radio controlled explosives are particularly effective in population dense environments such as those encountered in an urban warfare scenario. Of particular concern of late is the so called IED or improvised explosive device, which is relatively compact and may be remotely activated by e.g., an RF signal, and have even been known to be activated by cell phones connected to the IED so as to trigger an explosion upon the receipt of a call.

The techniques for dealing with these devices fall generally into two categories namely; a percussive technique which uses a transducer of some type to generate a shock wave which can trigger the device, the percussive type also including devices having parts designed for actual contact with the explosive device, and an electronic type which uses various electronic techniques for both finding and remotely detonating an explosive.

U.S. Pat. No. 6,487,950 issued to one Samland discloses a method of detecting and detonating land mines using microwave power at a first level for detection and a second level for detonation. While this method may be satisfactory for detonating passive condition responsive buried land mines, it does not address the issue of radio activated IEDs at all and thus cannot be used for that purpose.

U.S. Pat. No. 7,000,546 issued to Bender et al. Discloses a method of and device for detonating magnetic field responsive sea mines by generating a broad spectrum magnetic field extending about the perimeter of the vessel containing the device. Again, this device is only useful for detonating passive mine assemblies.

SUMMARY OF THE INVENTION

The present invention concerns a system and apparatus for detecting and neutralizing remotely activated explosive devices in a combat zone, especially one of relatively limited geographic area such as an urban setting. The apparatus is configured for mounting on or within an airborne drone and includes both transmitting and receiving circuits and antennas. The apparatus detects radio transmissions by analyzing received signals using standard RF direction finding techniques and a spectrum analyzer or other signal processing circuitry. Signals may be classified as threats using predetermined criteria, and the direction of threat signals may be assessed to allow for a determination of an enemy position from which an explosive is to be detonated. The apparatus also transmits a jamming signal which may serve to detonate devices within the dynamic RF footprint of the transmitting antenna. The drone also includes a highly directional low frequency audio device which is periodically directed randomly and at suspected enemy positions. A plurality of drones deployed within a given geographical area may transmit data to a base station, which can then transmit positional data in real time, which in combination with stored data may be used to optimize operational efficiency of the apparatus and allow for planning and altering troop movements.

In accordance with the above, it is an object of the invention to provide a system and apparatus for detecting and neutralizing remotely activated explosive devices in a combat zone.

It is another object of the invention to provide a system and apparatus for detecting and neutralizing remotely activated explosive devices in a combat zone having both transmitting and receiving circuits.

It is another object of the invention to provide a system and apparatus for detecting and neutralizing remotely activated explosive devices in a combat zone having one or more antennas configured for transmitting and receiving RF signals in accordance with the method of the invention.

It is another object of the invention to provide a system and apparatus for detecting and neutralizing remotely activated explosive devices which employs a remotely controlled and/or programmable drone aircraft.

It is another object of the invention to provide a system and apparatus for detecting and neutralizing remotely activated explosive devices in a combat zone which employs acoustic means to detonate explosive devices and disrupt enemy positions.

These and other objects of the present invention will become readily apparent upon further review of the following specification and drawings.

BRIEF DESCRIPTION OF THE DRAWINGS

FIG. 7A is a simulation of an aerial view of a scenario where the system of the invention is deployed.

DETAILED DESCRIPTION OF THE INVENTION

Figure 1:
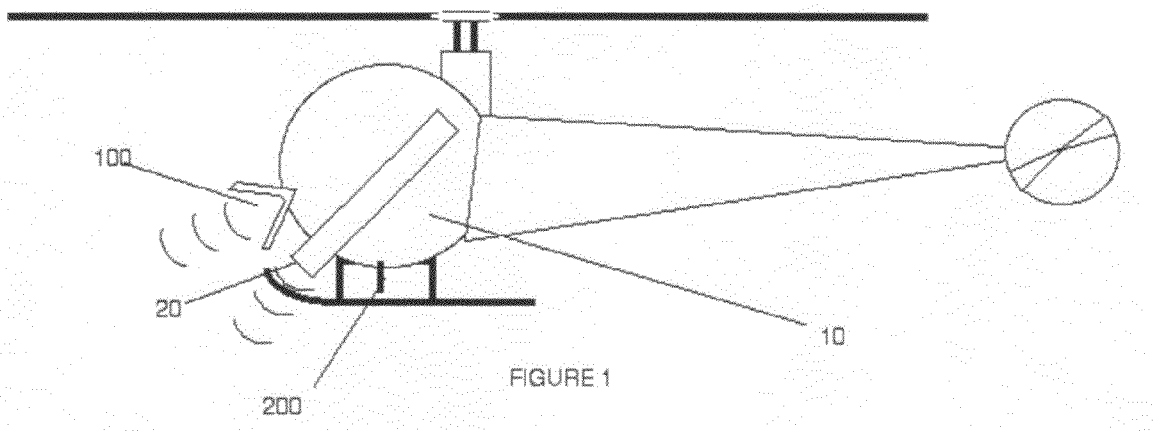
FIG. 1 is a side view of an apparatus for electronic and acoustic explosive detection and neutralization formed in accordance with the technique of the invention positioned on a drone aircraft.
Figure 2:
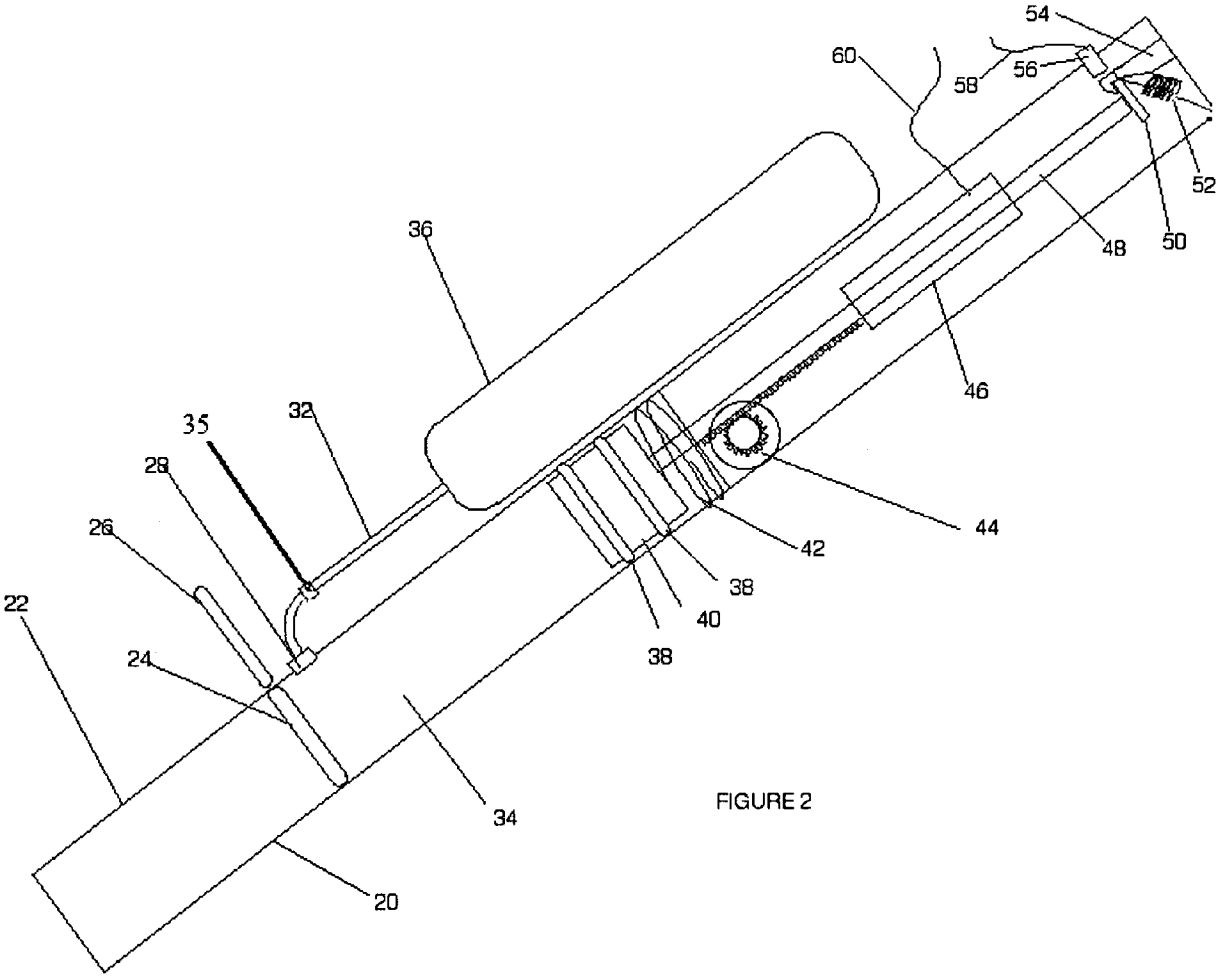
FIG. 2 is a side view, partly in cross section of the audio transducer portion of the apparatus.
Figure 3:
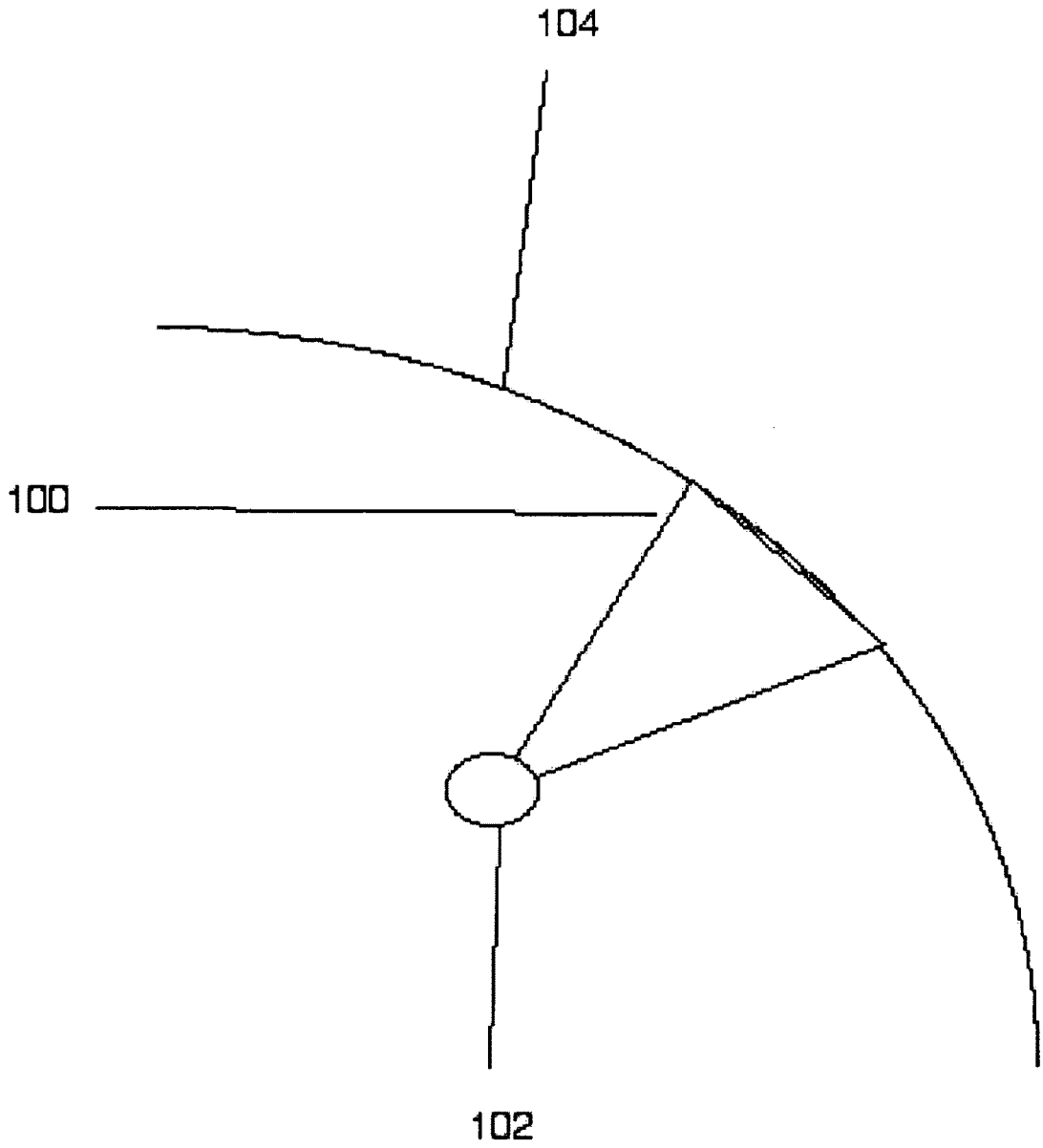
FIG. 3 is a side view of an antenna used with the RF receiving and transmitting portion of the apparatus.
Figure 4:
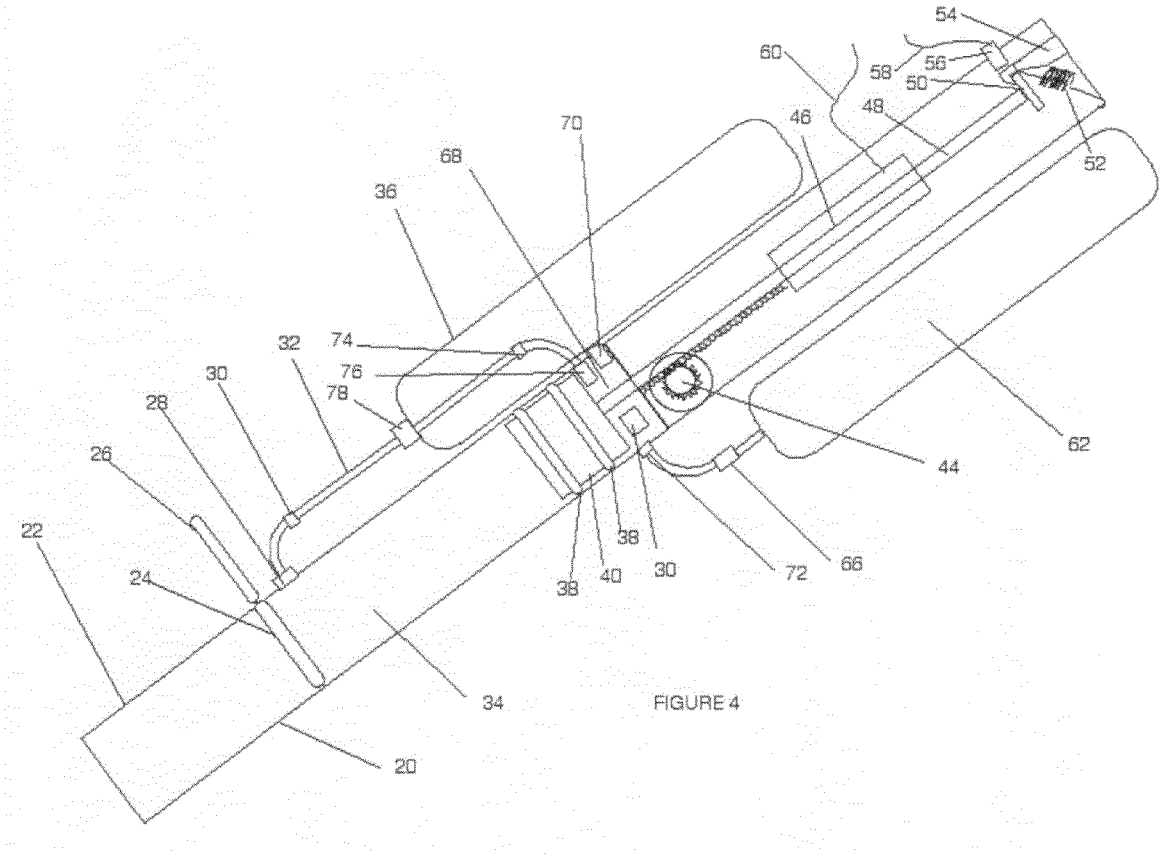
FIG. 4 is an alternative embodiment of the audio transducer portion of the apparatus.

Referring now to FIGS. 1-7B, a system for detecting and neutralizing concealed explosive devices positioned in a combat zone, is shown. The system, generally indicated by the numeral 10, is configured for use in a wartime environment, and particularly an urban setting. The apparatus used with the system 10 is configured to detect, neutralize, and/or destroy various types of explosive devices as may be deployed ay an enemy in a warfare scenario, and is particularly useful against the so called improvised explosive devices or IEDs, the weapon of choice for enemy soldiers and terrorists engaged in war with traditional standing or occupying armed forces. The system 10 may also be deployed to defeat traditional hidden explosive devices such as land mines.

Of particular concern for armies dealing with guerilla activities is the remotely controlled IED which may be hidden virtually anywhere but is most often used on or near roads to disrupt troop movements and discourage the normal functioning of a large urban area. These IEDs are especially difficult to neutralize because they are often hidden in other vehicles and may be detonated by a simple RF transmitter or even a cell phone. The apparatus 10 may be divided into two sections, operated in accordance with the system of the invention to detect, neutralize, and destroy all explosive devices of the condition responsive or remotely activated type. Preferably, the system 10 includes electronic and electrical systems mounted on a remotely controlled drone 12 such as a remotely controlled helicopter, but may alternatively be operated on an armored vehicle which may optionally be manned. The advantage of a drone aircraft 12 is that the device is not as susceptible to damage from the explosive devices regardless of whether it finds them or not. Also, the drone 12 can be operated only a few feet above the road surface unlike traditional drones which are operated high above the target area and thus incapable of employing all of the techniques of the invention. Also, the RF footprint of the drone 12 can be kept small so as not to interfere with normal, e.g., cell phone communications, within the target community.

In accordance with a key aspect of the invention, real time and stored data from past and current deployments of the drones 12 is used to control, and alter as necessary, the operation of the various sub-components of the drone 12, and to plan and/or alter routes taken by convoys using the drones 12 as will be explained in more detail later.

The first section of the electronic systems mounted on the drone 12 is the RF transmitting/receiving section which consists of an electronic transmitter and receiver circuit section 14 which is preferably digital and programmable. The transmitter/receiver circuit 14 should have separate outputs for the transmitting and receiving antennas. Transmitting antenna 100 consists of a primary transmitting element 102 which receives an output directly from the transmitter section of the transmitter/receiver circuit 14. A parabolic reflector 104 focuses the output of the element into a narrow beam to create a relatively narrow footprint to allow for linear movement of the drone 12, combined optionally with side to side sweeping movement of the antenna to scan an area having a width slightly wider than e.g., a road to be swept for IEDs. Movement of the antenna 100, which may be accomplished by a small microprocessor controlled motor 18 attached thereto, may be done under program control to allow for adjusting the area scanned particularly the width of the scan pattern. The electronic counter measure signal emitted from the transmitter 14 is frequency shifted in accordance with an adjustable predetermined algorithm to ensure that any IEDs in the area of the scan are irradiated with a signal approximating a detonation signal. The changing frequencies are designed to both detonate and/or interrupt detonation signals intended for the IED. Preferably, at least one microprocessor device (41) is used to coordinate the various electronic systems of the invention, the microprocessor capable of receiving and storing data associated with previous and current troop movements of all drones deployed within a given geographical area as will be described in more detail below.

Figure 5:
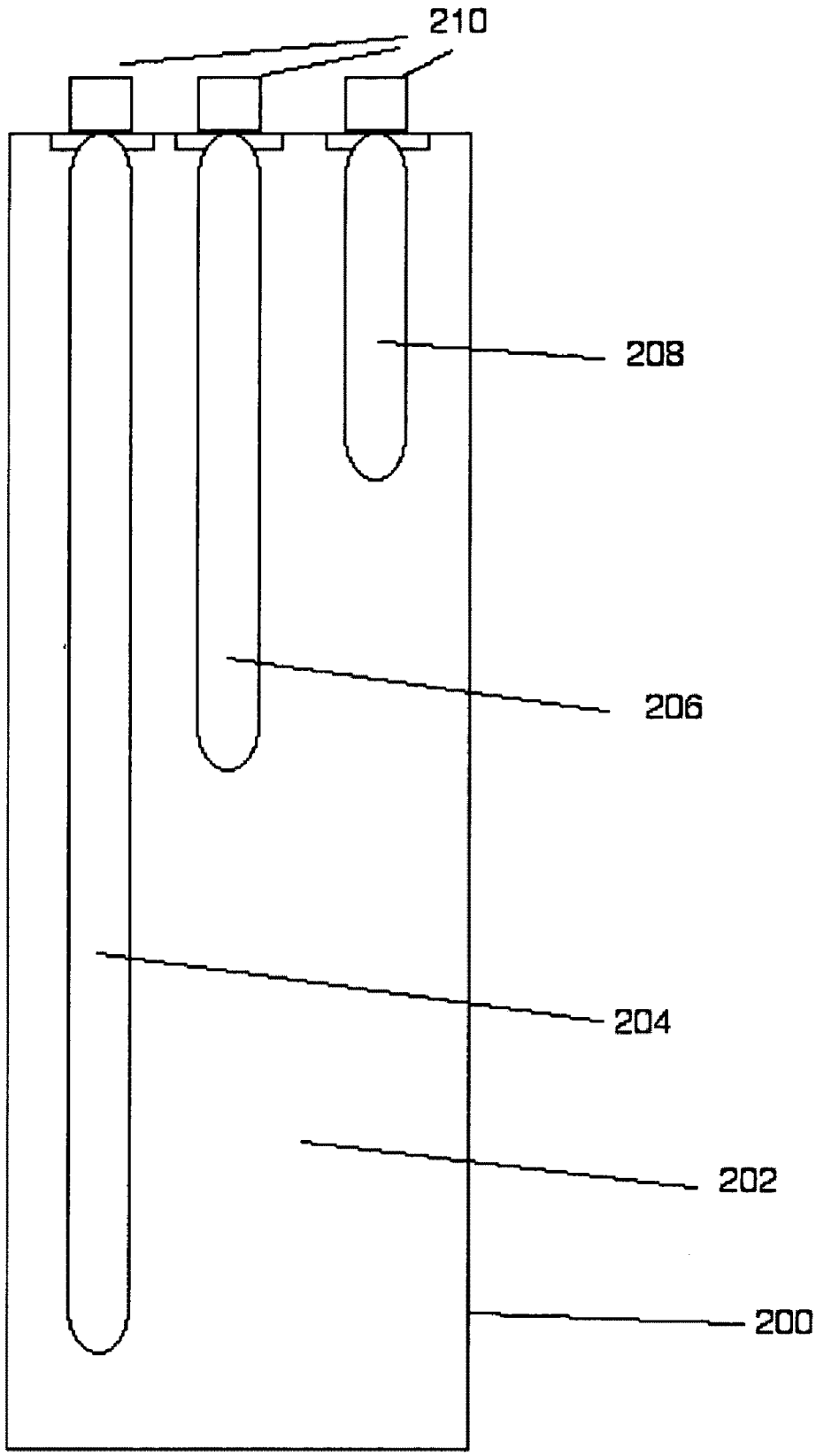
FIG. 5 is a side view of one quadrant showing a three-antenna arrangement.
Figure 6:
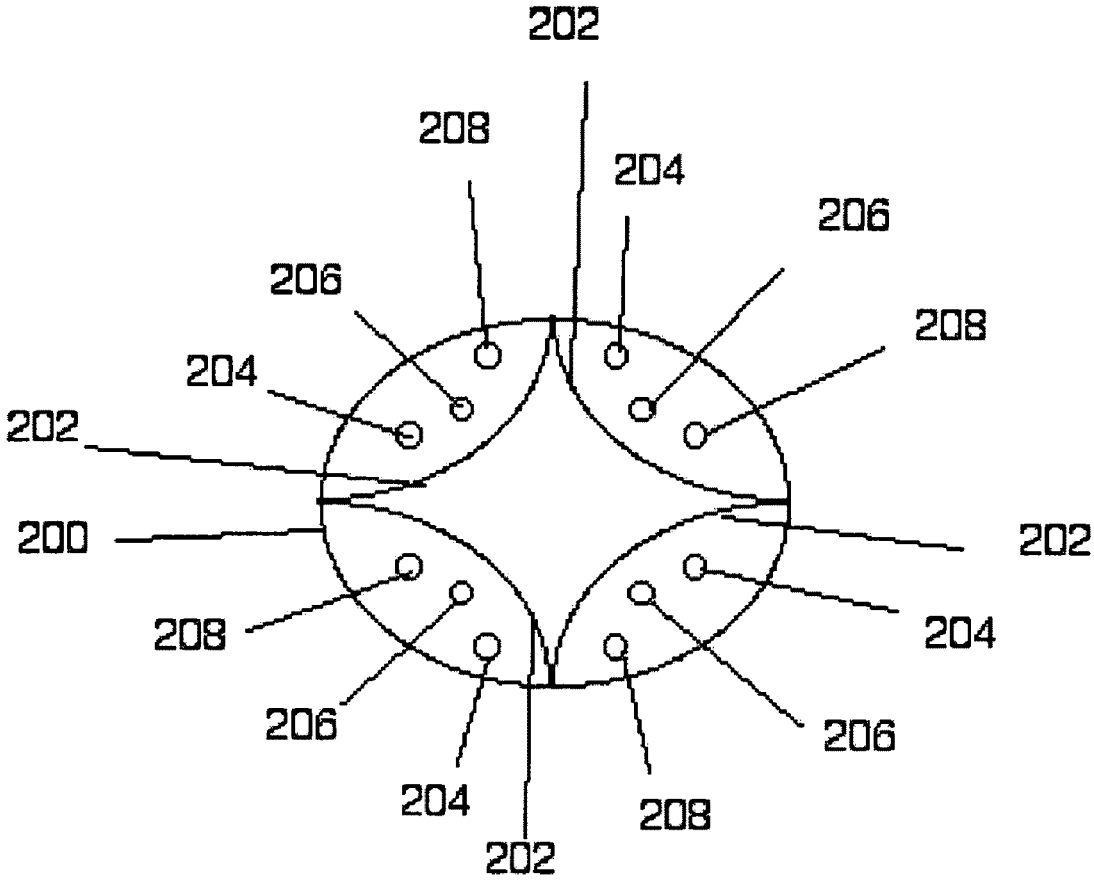
FIG. 6 is a top view showing an alternate embodiment of an antenna arrangement for the apparatus.
Figure 7B:
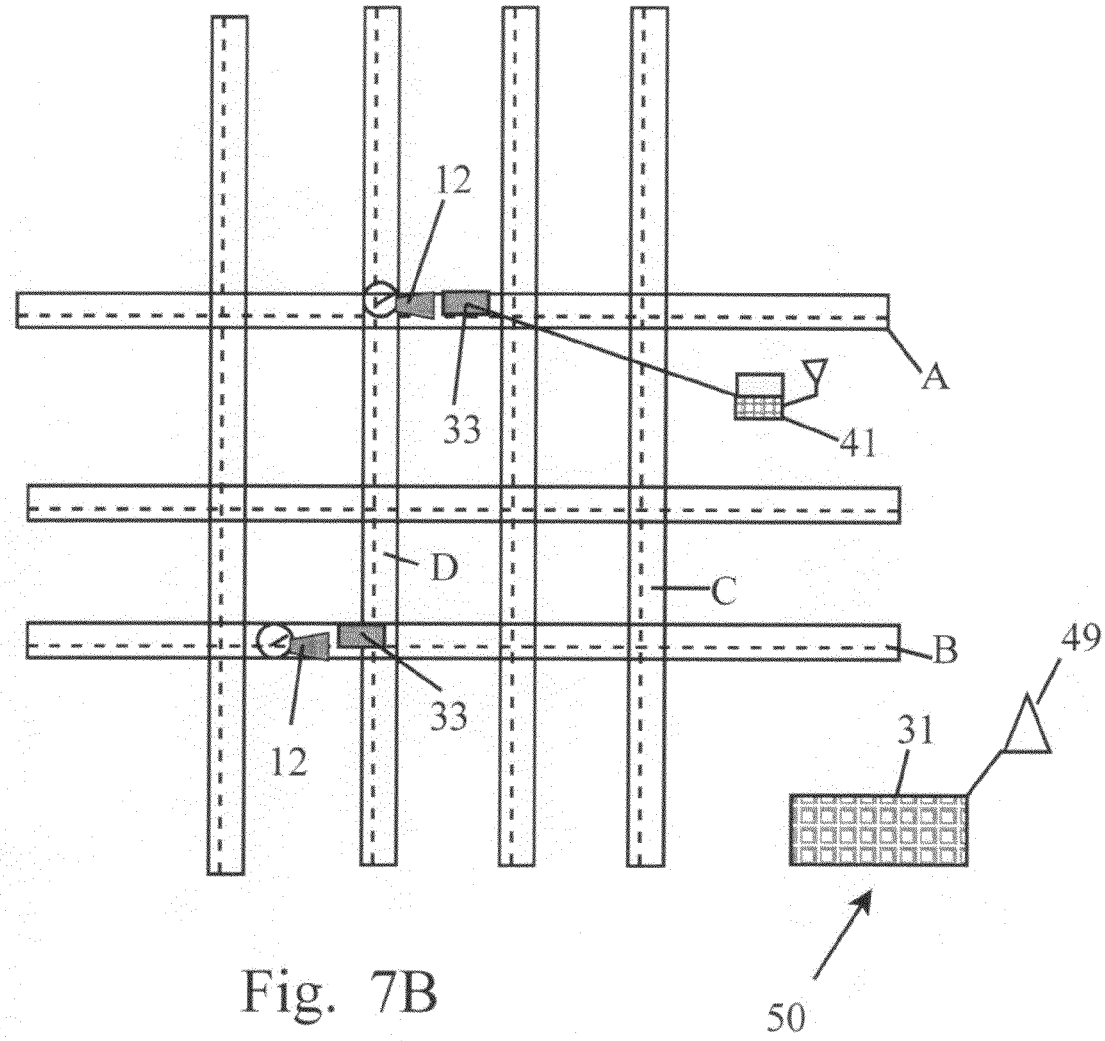
FIG. 7B is a plan view of a scenario where the system of the invention is deployed.

The receiving antenna 200 is of the direction finding type and may be formed of several elements as is known in the art. As shown in FIGS. 5 and 6, the antenna 200 has four groups of three dipole elements 204, 206, and 208 radially spaced and positioned within a housing 209 having terminals 210 for electrical connection to the receiving circuit 14. The dipole elements 204, 206, and 208 are of varying lengths and arranged from shortest to longest. An isolation reflector 202 extends lengthwise within the housing 209 and has four sides with concave surfaces for isolating the antenna groups.

The second section of the apparatus 10 is the sonic disruptor 20 which uses a high powered low frequency audio pulse to detonate land mines. The energy of the audio pulse is sufficient to detonate pressure or impact triggered explosive devices as is known in the art. The disruptor 20 is housed within a cylindrical muzzle 22 which contains a pressure diaphragm 24 capable of withstanding four atmospheric pressures. Compressed air or nonflammable gas is forced into compressed air or nonflammable gas chamber 34 from a source of compressed air or nonflammable gas contained within canister 36 through the compressed air or nonflammable gas line 32 and through the compressed air or nonflammable gas control valve 35. When the compressed air or nonflammable gas pressure in the compressed air or nonflammable gas chamber reaches three atmospheric pressures, the compressed air or nonflammable gas control valve 35 closes. At this point, the disruptor 20, is armed for firing.

Firing of the audio sound blast cannon, device 20, is initiated by applying power to the plunger shaft release trigger solenoid 56 and pulling the plunger shaft release trigger 54 pulled away from the plunger shaft stopper 50. At this point the plunger spring 42, with the assistance of the plunger shaft thrust solenoid 46 as power is applied over the plunger shaft solenoid control wires 60, accelerate the plunger 40 to sufficient speed to overcome the restraining force of the pressure diaphragm 24 forcing the compressed air or nonflammable gas out the muzzle 22. The plunger motor/gears 44 drive the plunger shaft 48 rearward to be locked into the firing position by the plunger shaft release trigger 54 locking onto the plunger shaft stopper 50. The plunger shaft trigger release spring 52 holds the plunger shaft release trigger 54 in place. Once the plunger shaft 48 is locked in place, the plunger motor/gear 44 is lifted slightly, clearing the plunger shaft gears and allowing the plunger shaft 48 to slide forward unimpeded. Concurrent with this action, a secondary pressure diaphragm 26 is automatically placed in the cannon muzzle 22.

Information gathered from drones operated in a given area can be transmitted in network fashion to continually indicate to a base station, as well as all troops deploying the drones, of actual or potential enemy IED deployment, thus several drones 12 operated by a plurality of troop convoys can provide real time troop data to enhance transport safety. Referring now specifically to FIGS. 7A and B, a typical scenario involving two drones 12 and two accompanying convoys which will include a lead vehicle 33 and optionally additional vehicles 43. The lead vehicle 33 will include control means for programming and real time control of the drone 12 preferably in the form of a laptop computer with pre-loaded software and a transmitting/receiving antenna 41. The software may include GPS data, local map information, etc. as required to provide a two dimensional map or grid from which the operator of the drone 12 can assess the relative positions of threats, other drones 12, topography, etc., as needed to navigate a preferred route and effect course changes as needed. It should be noted that the drones 12 are pre-programmed with a set of default instructions for operating the various sub-components as described above, which instructions may be readily modified in accordance with the deployment conditions. Alternatively, the control means 41 may include a menu driven software interface which forces the operator to select the various parameters such as detonation signal frequency and scan area upon initialization of the system 10 to ensure optimal deployment. As the convoys 33, 43 proceed real time information is transmitted to the base station 31 which correlates the data from each convoy 33, 43 and transmits data received from all convoys 32, 40 so that the information is stored and displayable in a useful fashion on all computers 41. The base station 31 includes a computer 50 having an antenna 49 operatively connected thereto for receiving data from the convoys, and transmitting threat and positional data in a format useful for display on the control means 41. If, for example, a "bogey" 37, 38 (e.g., anti-personnel mine, land mine, IED, etc.) is detected, data concerning the bogey 37 such as position, whether or not detonated, frequency of detonation, etc. is transmitted back to the base station 31 (by an operator entering data at the control means 41) and re-transmitted to all control means 41 currently operating to allow the user (e.g. the driver of a lead vehicle 33) to effect course changes etc. as needed. If, for example, convoys 33 are proceeding along roads A and B without incident, then the portions of roads A and B traversed may be indicated as clear for subsequent convoys. Data concerning cross roads C and D may have been already transmitted to the base station 31 by previous convoys so that the current convoys 33 can have information useful should an immediate course change be needed. The data obtained at the base station may also be correlated to allow for a determination of terrorist 39 position, e.g., activity centered around a given position. It should be noted that some data, particularly detonation of bogeys 37, 38, or visual confirmation of enemy position will have to be manually entered into control means 41 before it can be transmitted to the base station 31. Other data such as RF signals received by the receiving antenna is automatically stored on control means, where it may be transmitted to the base station 31 for further analysis.

In an alternative embodiment of the disruptor 20 a volatile fuel system is used for activating the plunger to expel the compressed air 34. Compressed air must be used with this system. A quantity of fuel is contained within a container 62. When the plunger 40 and plunger shaft 48 are moved to its cocking position, fuel is passed through the fuel spray nozzle 66 into the fuel chamber 68 behind the plunger. When the system is ready to fire, the trigger solenoid 56 is activated approximately 0.10 seconds prior to the fuel igniter 70 system being initiated. This will allow the plunger 40 and the plunger shaft 48 to move unimpeded. The fuel igniter 70 is then activated and the fuel is ignited causing the plunger 40 to press forward moving the compressed air 34 to expel it at sonic speed towards its objective. As the plunger is returned to the cocking position and the plunger shaft stopper 50 is latched by the plunger shaft release trigger 54, a one-way spent fuel exhaust valve 72 is opened to release spent fuel. This exhaust valve 72 is closed before the injecting of raw fuel into the firing chamber 68. After the compressed air is forced into the compressed air chamber 34 to approximately three atmospheres, through the compressed air inlet valve 28, the compressed air control valve 30 closes. As this action is completed, air is forced into the firing chamber 68 by way of the compressed air distributor 78, the compression check valve and 74, and the air injection nozzle 76. The compression check valve 74 closes to obtain a compression ration of approximately 11 to 1. All other action is identical to the spring firing system.

An alternative embodiment of the frequency directional finding antenna system device 200 may consist of four each, quadrant located, siamesed antennas consisting of three independently tuned dipole antennas with a isolation reflector. Each antenna wavelength may be tuned to a low frequency band 204, mid frequency band 206, and a high frequency band 208. These bands will be the expected frequencies that would be a compilation of frequencies nominally used for remotely controlled bombs and bomb detonators. The isolation reflector 202 would be designed to minimize interference to the other independent antenna systems. The four antenna systems may be contained within a nonconductive material. The antennas will be connected to the transmitter receiver section 14 which may optionally contain independent frequency analyzers for each antenna group and signal strength electronics thereby providing a general direction from which a suspected frequency is being generated. This information will then be processed by the transmitter receiver section 14 to aid in further defining the suspected frequency location.

In operation, the drone 12 is released by the user, e.g., a soldier in convoy lead vehicle 33 traversing a combat zone with a high risk of hidden IEDs etc. The drone 12 will sweep a predetermined area as programmed by the user, the area typically being linear and overlapping the intended route. For example, If the road is 25 meters wide, transmitting antenna 100 is oscillated so as to sweep an area 30 meters wide as the drone progresses linearly approximately centrally of the road. The oscillation rate of the antenna 100 would be selected and perhaps modified based upon response time and other parameters as would become apparent depending upon effectiveness over time. The detonation signals broadcast by the transmitting antenna 100 may be narrowed down by intelligence gathered to ensure a more effective scan (i.e., to more reliably detonate devices within the scan area of the transmitting antenna) and to reduce the amount of time the directional RF beam is focused on a particular area to allow for a quicker scan and faster troop movement. Receiving antenna 200 will receive and process RF transmissions to determine the direction and intensity of RF transmissions which may be intended to detonate an IED. Transmitter/receiver circuitry can adaptively change the RF jamming signal transmitted by antenna 100 in response to a received threat so that a broadband jamming signal is not mandated, and also to minimize unintended interference with local (non threat) RF signals. The information obtained from receiving antenna 200 can then be used to assess potential enemy positions, by e.g. triangulation or other well known techniques. Sonic disruptor 20 is also swept over the target area in much the same pattern as the transmitting antenna to detonate any hidden sub surface IEDs such as mines. All threats encountered by drone 12/convoy 33 are noted by the drone 12 operator and entered into the system using device 41, for transmission back to the base station 31, so that the data gathered from all drones 12 deployed over a period of time can be used to assess enemy positions and plan convoy 33 routes. Thus, the drones 12 used in accordance with the system can be used to gather data which can be transmitted to the base station 31 which includes data processing means 50 for storing and coordinating threat data. The threat data can then be continuously transmitted from the base station 31 so that any active drone 12 can access all current and previous data.

What is claimed is:

1. A system for locating and destroying explosive devices comprising:

a remotely controllable mobile support element for mounting and supporting transmitter, receiver, and disruptor sections of the system;

said transmitter section including a transmitting antenna array configured to broadcast a detonation signal over a predetermined area;

said receiver section including a receiving antenna array configured to receive RF signals over a wide bandwidth;

said disruptor section including an acoustic device for emitting a pressure wave;

a microprocessor positioned within said mobile support element and connected to send control signals to, and receive operating data from said transmitter, receiver, and disruptor sections.

2. The system of claim 1 wherein said system includes at least two remotely controllable mobile support elements, each of said elements having a portable signal processing and transmitting/receiving device associated therewith, and a single base station, said single base station adapted to receive signals from each of said portable signal processing devices.

3. The system of claim 1 wherein said pressure wave is of sufficient energy to detonate pressure or impact sensitive explosive devices.

4. The system of claim 2 wherein said base station includes an antenna and computer connected thereto for receiving threat and positional data from said portable signal processing means, and transmitting threat and positional data to said portable signal processing devices.

5. The system of claim 4 wherein said threat and positional data transmitted from said base station can be displayed by said portable signal processing devices.

6. A system for locating and destroying explosive devices comprising:

a remotely controllable mobile support element for mounting and supporting transmitter, receiver, and disruptor sections of the system;

said transmitter section including a transmitting antenna array configured to broadcast a detonation signal over a predetermined area;

said receiver section including a receiving antenna array configured to receive RF signals over a wide bandwidth;

said disruptor section including an acoustic device for emitting a pressure wave;

a microprocessor positioned within said mobile support element and connected to send control signals to, and receive operating data from said transmitter, receiver, and disruptor sections;

said mobile support element having a portable signal processing and transmitting/receiving device;

a base station, said base station adapted to receive signals from said portable signal processing device.

7. The system of claim 6 wherein said base station includes an antenna and computer connected thereto for receiving threat and positional data from said portable signal processing device, and transmitting threat and positional data to said portable signal processing device.

8. The system of claim 7 wherein said threat and positional data transmitted from said base station can be displayed by said portable signal processing device.

9. The system of claim 6 wherein said pressure wave is of sufficient energy to detonate pressure or impact sensitive explosive devices.

10. The system of claim 8 wherein said detonation signal is broadcast over a predetermined range of frequencies, said predetermined range of frequencies modified in accordance with said threat and positional data.

* * * * *